US008274470B2

(12) United States Patent
Seong et al.

(10) Patent No.: US 8,274,470 B2
(45) Date of Patent: Sep. 25, 2012

(54) BACKLIGHT UNIT, DISPLAY APPARATUS AND CONTROL METHOD THEREOF

(75) Inventors: Ki-bum Seong, Anyang-si (KR); Jun-ho Sung, Seoul (KR); Yung-jun Park, Yongin-si (KR); Jeong-il Kang, Yongin-si (KR); Su-gun Kim, Yongin-si (KR); Hyung-rae Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1328 days.

(21) Appl. No.: 11/866,427

(22) Filed: Oct. 3, 2007

(65) Prior Publication Data

US 2008/0238858 A1 Oct. 2, 2008

(30) Foreign Application Priority Data

Mar. 30, 2007 (KR) ..... 10-2007-0031578

(51) Int. Cl.
*G09G 3/36* (2006.01)

(52) U.S. Cl. ..... 345/102; 345/87; 345/89; 345/211; 345/690

(58) Field of Classification Search ..... 345/87, 345/89, 102, 204, 211–213, 690
See application file for complete search history.

(56) References Cited

U.S. PATENT DOCUMENTS 7,298,358 B2 11/2007 Honbo
7,505,026 B2 * 3/2009 Baba et al. ..... 345/102
2005/0062681 A1 * 3/2005 Honbo ..... 345/10
2009/0040173 A1 * 2/2009 Ezaki et al. ..... 345/102
2010/0002009 A1 * 1/2010 Takata ..... 345/589
2010/0134522 A1 * 6/2010 De Rijck ..... 345/690

FOREIGN PATENT DOCUMENTS

JP 11-52327 A 2/1999
KR 10-2005-0030123 A 3/2005
KR 10-2005-0087478 A 8/2005
KR 10-2006-0109847 A 10/2006

OTHER PUBLICATIONS

Communication dated Dec. 27, 2011 from the Korean Intellectual Property Office in counterpart Korean application No. 10-2007-0031578.

* cited by examiner

*Primary Examiner* — Quan-Zhen Wang
*Assistant Examiner* — Jennifer Nguyen
(74) *Attorney, Agent, or Firm* — Sughrue Mion, PLLC

(57) ABSTRACT

A display apparatus includes: a display panel; a light source unit which comprises a light source and has a plurality of division areas which are separated and independently driven each other, and is located at the back of the display panel; a drive unit which supplies drive power for the light source unit; and a light source controller which controls the drive unit so that the drive power can be supplied sequentially to the division areas which are divided in a first direction, in synchronization with a scanning period for which one frame of an image signal is displayed, and a lighting period of the division areas can be changed according to the kind of the image signal which is displayed on the display panel.

30 Claims, 9 Drawing Sheets

BACKLIGHT UNIT, DISPLAY APPARATUS AND CONTROL METHOD THEREOF

CROSS-REFERENCE TO RELATED APPLICATIONS

This application claims priority from Korean Patent Application No. 10-2007-0031578, filed on Mar. 30, 2007, in the Korean Intellectual Property Office, the disclosure of which is incorporated herein by reference.

BACKGROUND OF THE INVENTION

1. Field of the Invention

Apparatuses and methods consistent with the present invention relate to a backlight unit, a display apparatus and a control method thereof, and more particularly, to a backlight unit including a plurality of light sources, a display apparatus and a control method thereof.

2. Description of the Related Art

Flat panel display devices such as liquid crystal displays (LCDs), plasma display panels (PDPs), and organic light emitting diodes (OLEDs) are being developed in place of conventional cathode ray tubes (CRTs). Among them, a liquid crystal display includes a thin film transistor substrate, a color filter substrate and a liquid crystal display panel where liquid crystal is filled between both the substrates. Since the liquid crystal display panel is a non-light emitting device, a backlight unit is located at the rear surface of the thin film transistor substrate, in order to supply light for the liquid crystal display panel. A transmission amount of light emitted from the backlight unit is adjusted according to a state where liquid crystal is aligned. The liquid crystal display panel and the backlight unit are accommodated within a chassis.

Line light sources such as lamps and point light sources such as light emitting diodes, are usually used as light sources for the backlight unit.

To improve quality of motion images in the case of the liquid crystal display, various kinds of drive methods are used. Accordingly, drive methods of the backlight unit are being developed in various forms.

SUMMARY OF THE INVENTION

It is an aspect of the present invention to provide a backlight unit, a display apparatus and a control method thereof, in which video drag and flicker are reduced.

It is another aspect of the present invention to provide a backlight unit, a display apparatus and a control method thereof, in which number of drivers which supply driving power to a light source unit is reduced, thereby saving a manufacturing cost.

Additional aspects of the present invention will be set forth in part in the description which follows and, in part, will be obvious from the description, or may be learned by practice of the present invention.

The foregoing and/or other aspects of the present invention are achieved by providing a display apparatus including: a display panel; a light source unit which includes a light source and has a plurality of division areas which are separated and independently driven from each other, and is located at the back of the display panel; a drive unit which supplies drive power for the light source unit; and a light source controller which controls the drive unit so that the drive power can be supplied sequentially to the division areas which are divided in a first direction, in synchronization with a scanning period for which one frame of an image signal is displayed, and a lighting period of the division areas can be changed according to the kind of the image signal which is displayed on the display panel.

According to an aspect of the invention, if the image signal displayed on the display panel is a motion image, the lighting period of the division areas is equal to the scanning period.

According to an aspect of the invention, if the image signal displayed on the display panel is a still image, the lighting period of the division areas is 1/n times of the scanning period.

According to an aspect of the invention, the division areas are arranged in a matrix form, and the drive unit includes a plurality of multiple-drivers which are connected with at least two of the division areas which belong to different rows which are distant from each other.

According to an aspect of the invention, turn-on sections of the division areas which are connected with the multiple-drivers do not overlap with one another.

According to an aspect of the invention, the division areas are arranged in an N×M matrix form, the first direction is a column direction, the division areas include a first division area which is arranged in the $i^{th}$ row and a second division area which is arranged in the $(M/2+i)^{th}$ row in the first direction, respectively, and the multiple-driver supplies the drive power to the first division area and the second division area.

According to an aspect of the invention, if both an image signal corresponding to the first division area and an image signal corresponding to the second division area are motion images, the lighting periods of the first and second division areas are equal to the scanning period, and start time of the turn-on section of the first division area is different from start time of the turn-on section of the second division area by the scanning time divided by 2.

According to an aspect of the invention, the turn-on sections of the division areas are about 10% through 50% of the scanning period.

According to an aspect of the invention, if both an image signal corresponding to the first division area and an image signal corresponding to the second division area are still images, the lighting periods of the first and second division areas are equal to the scanning period divided by 2, and start time of the turn-on section of the first division area is different from start time of the turn-on section of the second division area by the scanning period divided by 4.

According to an aspect of the invention, the turn-on sections of the first and second division areas is about 10% through 25% of the scanning period.

According to an aspect of the invention, if one of image signals corresponding to the first and second division areas is a motion image and the other is a still image, the lighting period of the division area corresponding to the motion image is equal to the scanning period and the lighting period of the division area corresponding to the still image is equal to the scanning period divided by 2.

According to an aspect of the invention, the turn-on section of the division area corresponding to the motion image is about 10% through 33% of the scanning period, and the turn-on section of the division area corresponding to the still image is about 10% through 16% of the scanning period.

According to an aspect of the invention, the light source includes at least one of a point light source and a surface light source.

The foregoing and/or other aspects of the present invention are achieved by providing a backlight unit including: a light source unit which includes a plurality of light sources and has division areas which are partitioned in a matrix form and independently driven from one another; a drive unit which includes a multiple-driver which is connected with at least two division areas belonging to different rows which are distant from each other; and a light source controller which controls the drive unit so that drive power is sequentially supplied to the division areas which are divided in a first direction, in synchronization with a predetermined scanning period, and lighting periods of the division areas are independently changed.

According to an aspect of the invention, turn-on sections of the division areas which are connected with the multiple-driver do not overlap with one another.

According to an aspect of the invention, the division areas are arranged in an N×M matrix form, the first direction is a column direction, the division areas include a first division area which is arranged in the $i^{th}$ row and a second division area which is arranged in the $(M/2+i)^{th}$ row in the first direction, respectively, and the multiple-driver supplies the drive power to the first division area and the second division area.

According to an aspect of the invention, if one of the first and second division areas has a first lighting period which is the same as the scanning period and the other has a second lighting period which corresponds to the first lighting period divided by 2, the turn-on section of the division area having the first lighting period is about 10% through 33% of the scanning period, and the turn-on section of the division area having the second lighting period is about 10% through 16% of the scanning period.

According to an aspect of the invention, the light source includes at least one of a point light source and a surface light source.

The foregoing and/or other aspects of the present invention are achieved by providing a control method of a display apparatus including a display panel, a light source unit having a plurality of light sources, having division areas which are divided and located at the back of the display panel, and a drive unit which supplies drive power to the light source unit, the control method including: establishing a lighting period of each division area so as to be changed according to the kind of an image signal displayed on the display panel; and sequentially supplying the division areas divided in a first direction with the drive power corresponding to the lighting periods which have been established, in synchronization with a scanning period during which one frame of the image signal is displayed, to thereby drive the display apparatus.

According to an aspect of the invention, if the image signal displayed on the display panel is a motion image, the lighting period of the division areas is equal to the scanning period.

According to an aspect of the invention, if the image signal displayed on the display panel is a still image, the lighting period of the division areas is a fraction of the scanning period.

According to an aspect of the invention, the division areas are arranged in an N×M matrix form, the first direction is a column direction, the division areas include a first division area which is arranged in the $i^{th}$ row and a second division area which is arranged in the $(M/2+i)^{th}$ row in the first direction, respectively, and the display apparatus further includes a multiple-driver which supplies the drive power to the first division area and the second division area.

According to an aspect of the invention, the driving includes supplying the drive power to the first and second division areas so that turn-on sections of the first and second division areas which are connected with the multiple-driver do not overlap with one another.

According to an aspect of the invention, if both an image signal corresponding to the first division area and an image signal corresponding to the second division area are motion images, the lighting periods of the first and second division areas are equal to the scanning period, and start time of the turn-on section of the first division area is different from start time of the turn-on section of the second division area by the scanning period divided by 2.

According to an aspect of the invention, if both an image signal corresponding to the first division area and an image signal corresponding to the second division area are still images, the lighting periods of the first and second division areas are equal to the scanning period divided by 2, and start time of the turn-on section of the first division area is different from start time of the turn-on section of the second division area by the scanning period divided by 4.

According to an aspect of the invention, if one of image signals corresponding to the first and second division areas is a motion image and the other is a still image, the lighting period of the division area corresponding to the motion image is equal to the scanning period and the lighting period of the division area corresponding to the still image is equal to the scanning period divided by 2.

BRIEF DESCRIPTION OF THE DRAWINGS

The above and/or other aspects of the present invention will become apparent and more readily appreciated from the following description of the exemplary embodiments, taken in conjunction with the accompanying drawings in which.

DETAILED DESCRIPTION OF THE INVENTION

Figure 1:
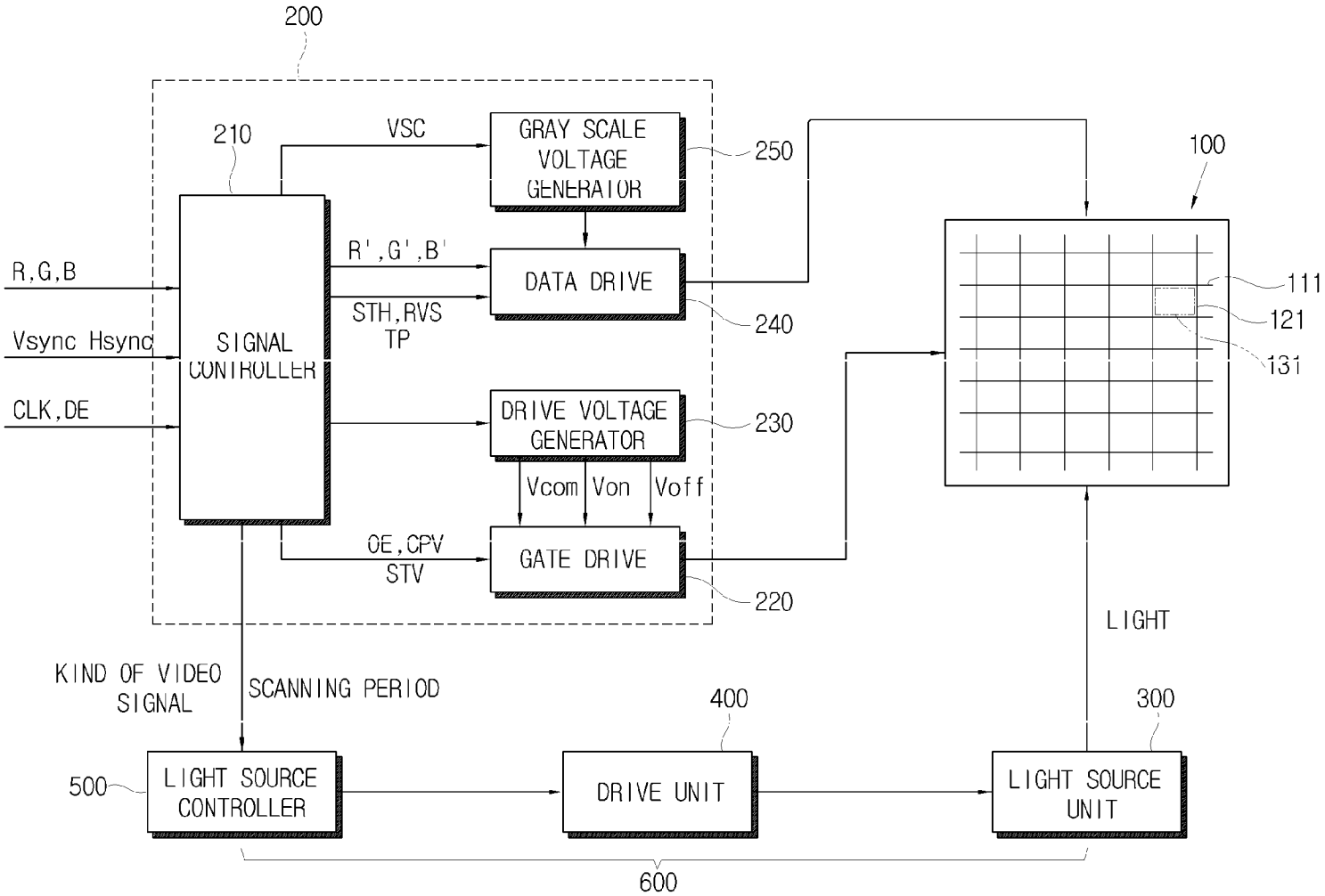
FIG. 1 is a block diagram showing a display apparatus according to an exemplary embodiment of the present invention.

Reference will now be made in detail to exemplary embodiments of the present invention, examples of which are illustrated in the accompanying drawings, wherein like reference numerals refer to like elements throughout. Identical components are representatively described in a first exemplary embodiment, and the detailed description thereof will be omitted in other exemplary embodiments. The exemplary embodiments are described below in order to explain the present invention by referring to the figures.

Figure 2:
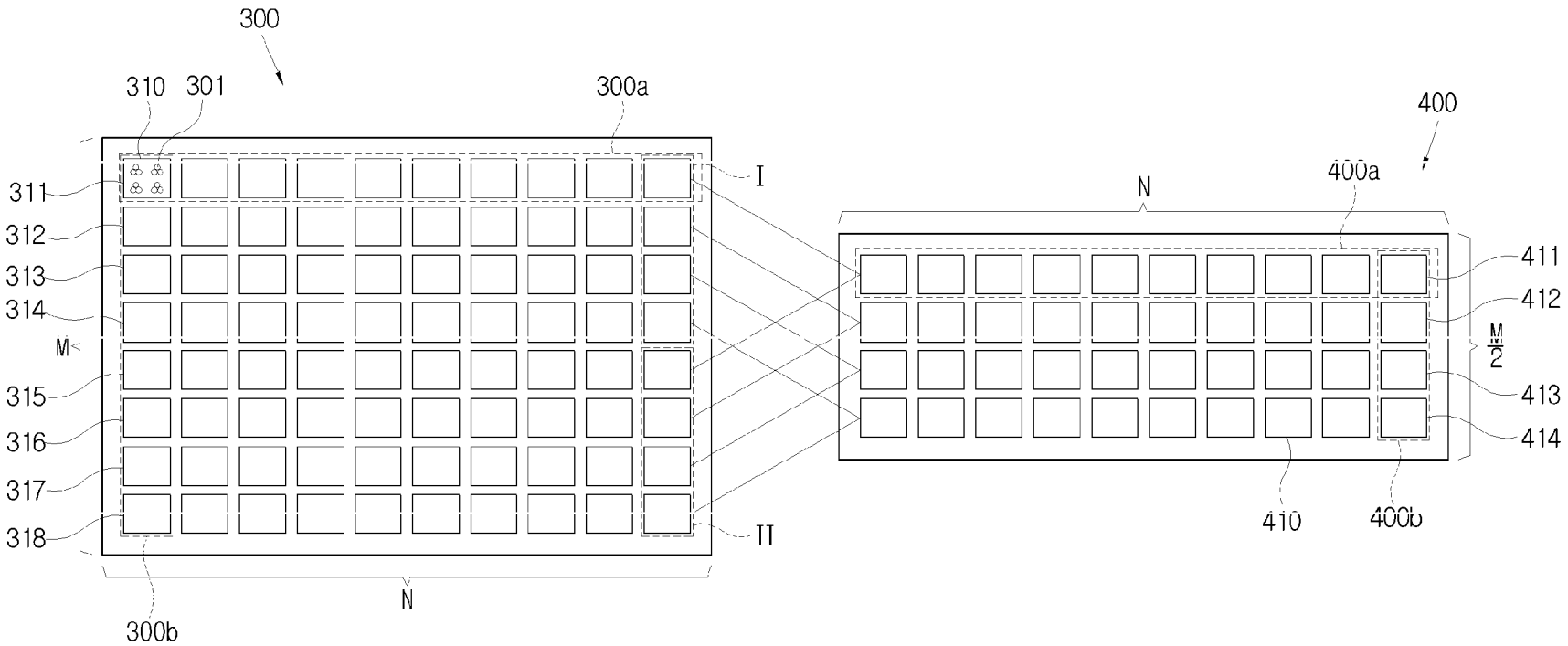
FIG. 2 is a schematic diagram illustrating a backlight unit according to an exemplary embodiment of the present invention.

FIG. 1 is a block diagram showing a display apparatus according to an exemplary embodiment of the present invention, and FIG. 2 is a schematic diagram showing a backlight unit according to an exemplary embodiment of the present invention.

As illustrated, a display apparatus according to an exemplary embodiment of the present invention includes a display panel 100, a panel driver 200 which drives the display panel 100, and a backlight unit 600 which supplies light for the display panel 100. The display panel 100 in this exemplary embodiment is a liquid crystal panel including a liquid crystal layer (not shown) and may be implemented into other display panels without being limited to the liquid crystal panel if light is supplied from the backlight unit 600. The backlight unit 600 which is provided at the back of the display panel 100 includes a light source unit 300, a drive unit 400 which drives the light source unit 300, and a light source controller 500 which controls the drive unit 400.

The display panel 100 includes a first substrate (not shown) on which a thin film transistor is formed, a second substrate (not shown) which faces the first substrate, and a liquid crystal layer which is formed between the first and second substrate. Gate lines 111, data lines 121, and a plurality of pixels 131 which are defined as interaction regions crossing the gate lines 111 and the data lines 121 and which are of a matrix form including thin film transistors (not shown) are formed on the display panel 100.

The panel driver 200 includes a gate driver 220 which is connected with the gate lines 111, a data driver 240, a drive voltage generator 230 which is connected with the gate drive 220, a gray scale voltage generator 250 which is coupled with the data driver 240, and a signal controller 210 which controls the gate driver 220, the data drive 240, the drive voltage generator 230 and the gray scale voltage generator 250, and which receives image signals from an external image source such as a graphic controller.

The drive voltage generator 230 generates a gate-on voltage Von which turns on a thin film transistor, a gate-off voltage Voff which turns off the thin film transistor, and a common voltage Vcom which is applied to the common electrode.

The gray scale voltage generator 250 generates a plurality of gray scale voltages related to brightness of the display apparatus and supplies the generated gray scale voltages to the data driver 240.

The gate driver 220 is called a scan driver and is connected with the gate lines 111, to thereby apply to the gate lines 111 a gate signal which is composed of a combination of a gate-on voltage Von and a gate-off voltage Voff supplied from the drive voltage generator 230.

The data driver 240 is called a source driver, and receives a gray scale voltage from the gray scale voltage generator 250 and selects a gray scale voltage for each of the data lines 121 under the control of a signal controller 210 to then apply the selected gray scale voltage to the data lines 121.

The signal controller 210 generates and outputs control signals which control operations of the gate driver 220, the data driver 240, the drive voltage generator 230 and the gray scale voltage generator 250. Also, the signal controller 210 provides the light source controller 500 with information about the scanning period of the image signal and the kind of the image signal.

The signal controller 210 receives RGB image data R, G, B and input control signals which control display of the RGB image data R, G, B from outside. For example, the input control signals are a vertical synchronization signal Vsync, a horizontal synchronization signal Hsync, a main clock CLK, and a data enable signal DE and other known input control signals in the art. The signal controller 210 generates a gate control signal, a data control signal and a voltage selection control signal VSC, based on the input control signals, and converts video data R, G, B into video data R', G', B' according to an operational condition of the display panel 100, sends a gate control signal to the gate driver 220 and sends a data control signal and the processed image data R', G', B' to the data driver 240, and sends the voltage selection control signal VSC to the gray scale voltage generator 250.

The gate control signal includes a vertical synchronization start signal STV which instructs start of output of a gate-on pulse (a High section of a gate signal), a gate clock signal which controls output timing of the gate-on pulse, and a gate-on enable signal OE which limits width of the gate-on pulse. The data control signal includes a horizontal synchronization start signal STH which instructs start of input of the gray scale signal, a load signal LOAD or TP which applies a relevant data voltage to the data lines, a reverse control signal RVS which reverses polarity of the data voltage and a data clock signal HCLK.

First, the gray scale voltage generator 250 supplies the data driver 240 with a gray scale voltage having a voltage value determined according to the voltage selection control signal VSC.

The gate driver 220 applies a gate-on voltage Von to the gate lines 111 sequentially, according to the gate control signal from the signal controller 210 and turns on a thin film transistor which is connected with the gate lines 111. Simultaneously, the data driver 240 supplies a corresponding data line 121 with an analog data voltage corresponding to the video data R', G', B' and given from the gray scale voltage generator 250, as a data signal, according to the data control signal from the signal controller 210.

The data signal supplied to the data line 121 is applied to a corresponding pixel 131 through a thin film transistor which has been turned on. In this manner, a gate-on voltage Von is applied to all the gate lines 111 sequentially for one frame so that a data signal can be applied to all the pixels. If one frame ends and a reverse control signal RVS is supplied to the data driver 240, polarities of all data signals of the next frame change.

As illustrated in FIG. 2, the light source unit 300 includes a plurality of division areas 310 which are divided in a matrix form including point light sources 301, and supplies light for the display panel 100. The point light source 301 according to this exemplary embodiment is a light emitting diode and is distributed uniformly over the whole surface of a light emitting diode circuit substrate (not shown) that is located at the back of the display panel 100. The point light source 301 includes a light emitting diode unit which emits red, green and blue colors or further includes a white light emitting diode. The kind of the point light source 301 is not limited to the light emitting diode, and may include a laser diode or an oxygen nano-scale tube.

According to another exemplary embodiment, the light source unit 300 may include a surface light source other than the point light source. That is, surface light source is divided into a plurality of areas for the areas to be arranged in a matrix form and connected with the multiple-drivers 410.

The division areas 310 are partitioned in an N×M matrix form, that is, the division areas 310 include M division area rows 300*a* which are divided in an extended direction (a second direction) of the gate lines 111 and N division area columns 300*b* which are divided in an extended direction (a first direction) of the data lines 121. Each division area 310 is driven independently from one another by the multiple-drivers 410 included in the drive unit 400. One division area row 300*a* includes N division areas 310 and one division area column 300*b* includes M division areas 310. According to this exemplary embodiment, the division areas 310 are partitioned in a matrix form of 10×8 over the whole light source unit 300, and one division area column 300*b* includes 8 division areas 310.

The drive unit 400 which supplies electric power for the light source unit 300 includes a plurality of multiple-drivers 410. The number of the multiple-drivers 410 is smaller than the number of the division areas 310. According to this exemplary embodiment, the number of the multiple-drivers 410 are provided with N×M/2 which is half of the number of the division areas 310. The multiple-drivers 410 are also arranged in a matrix form, and include multiple-driver rows 400*a* including N multiple-drivers 410 and multiple-driver columns 400*b* including M/2 multiple-drivers 410. The multiple-driver 410 is connected with two division areas 310 which are included in one division area column 300*b* and are distant from each other, and supplies drive power for the two division areas 310. As illustrated, a first multiple-driver 411 in a first multiple-driver column 400*b* which is arranged in a column direction (the first direction) supplies drive power for the first division area 311 and the fifth division area 315, and a second multiple-driver 412 supplies drive power for the second division area 312 and the sixth division area 316. Also, the division areas 310 which are disposed in different division area columns 300*b* are not connected with the identical multiple-driver 410. That is, one multiple-driver column 400*b* drives one division area column 300*a*. If this is generalized, a multiple-driver 410 is connected with the division area 310 of the $i^{th}$ row and the division area 310 of the $(M/2+i)^{th}$ row which are arranged in the same column direction. Also, the division areas 310 which are connected with one multiple-driver 410 is distant from each other by M/2 row. Since the division area 310 is individually driven by the connected multiple-driver 410, N×M drivers are all required to drive the division areas which are partitioned in an N×M matrix form, in the case of the conventional art. However, in the exemplary embodiment of the present invention, the total number of drivers to drive the division areas 310 which are a kind of independent point light source groups is reduced to half in comparison with the conventional art. Accordingly, a manufacturing cost is reduced, the display apparatus is simply constructed, and volume of the display apparatus is reduced.

According to another exemplary embodiment of the present invention, the number of the division areas 310 which are connected with one multiple-driver 410 may be three or more, and a single driver may be provided to drive one division area 310, as being the case. Also, the drive unit 400 may include multiple-drivers which are connected with the respectively different number of the division areas 310. This may be varied according to size of the display apparatus and a scanning period of an image signal.

For convenience of explanation, division areas 311 through 314 located in the upper portion in a column direction (a first direction) among the division areas 310 which are connected with the multiple-driver 410 is named as a first division area, and division areas 315 through 318 located in the lower portion in the column direction (the first direction) is named as a second division area.

The light source controller 500 receives a scanning period of an image signal to be displayed on the display panel 100 from the signal controller 210, and controls the drive unit 400 so that the division area column 300*b* is driven according to the scanning period. That is, as drive power is sequentially supplied from the first division area row 300*a* to the eighth division area row 300*a* for the scanning period during which one frame image signal is displayed, the division area 310 is also scanned. A scan interval between the respective division area rows 300*a* will become the scanning period divided by M. The division area 310 has a turn-on section during which drive power is supplied and a turn-off section during which drive power is not supplied. Here, a period between the turn-on section and the turn-off section is called a lighting period. Such a drive system which turns off the light sources included in the light source unit 300 while scanning light sources does not supply light for the display panel 100 during the turn-off section, to thereby obtain an impulsive drive effect such as in a cathode ray tube (CRT). The impulsive drive provides an effect of preventing a drag phenomenon of motion images when the motion images are displayed on the display panel 100, and an effect of improving quality of the image signals on the whole.

The lighting period may equal a scanning period or be shorter than the scanning period. As the lighting period is short, the turn-on/turn-off operations of the division area 310 are performed faster. In the case that the lighting period equals the scanning period, the division area 310 is turned on once while one frame is formed. The turn-on section during which the impulsive drive is embodied and a video drag phenomenon is prevented is about 10-50% of the scanning period, and about 25-35% thereof more preferably. In the case that the lighting period is shorter than the scanning period, the division area 310 can be turned on twice or more while one frame is formed. In this case, although the turn-on section can be lower than the above-described ratio, a sum of the whole turn-on section may be about 25-35% during formation of one frame. That is, one division area 310 may be turned on for about 25-35% of a frame, and may be turned off for about 65-75% of the frame, during one frame.

In addition, the light source controller 500 controls the drive unit 400 so that the first division area and the second division area which are connected with the multiple-driver 410 are driven with a time difference, that is, the turn-on sections of the first division area and the second division area do not overlap with each other. Accordingly, the multiple-driver 410 can drive a pair of division areas (and) without collision. Also, the light source controller 500 controls the drive unit 400 so that the lighting period of the division area 310 is changed according to the kind of the image signal displayed on the display panel 100. The light source controller 500 establishes a lighting period of the division area 310 to be identical with the scanning period if the image signal is a motion image. The light source controller 500 establishes a lighting period of the division area 310 to be 1/n times as long as the scanning period if the image signal is a still image. That the lighting period becomes 1/n times as long as the scanning period means that the division area 310 is turned on n times for the scanning period. Even in this case, the total time when the division area 310 becomes turned on is about 10-50% of the scanning period, preferably but not necessarily about 25-35% thereof. Conclusively, the lighting period is established according to the ordinary impulsive drive, in the case of the motion image, to thus prevent a video drag phenomenon, and a turn-on/turn-off period is shortened in order to prevent a flicker which occurs in the display panel 100 in the case of the still image.

Figure 3A:
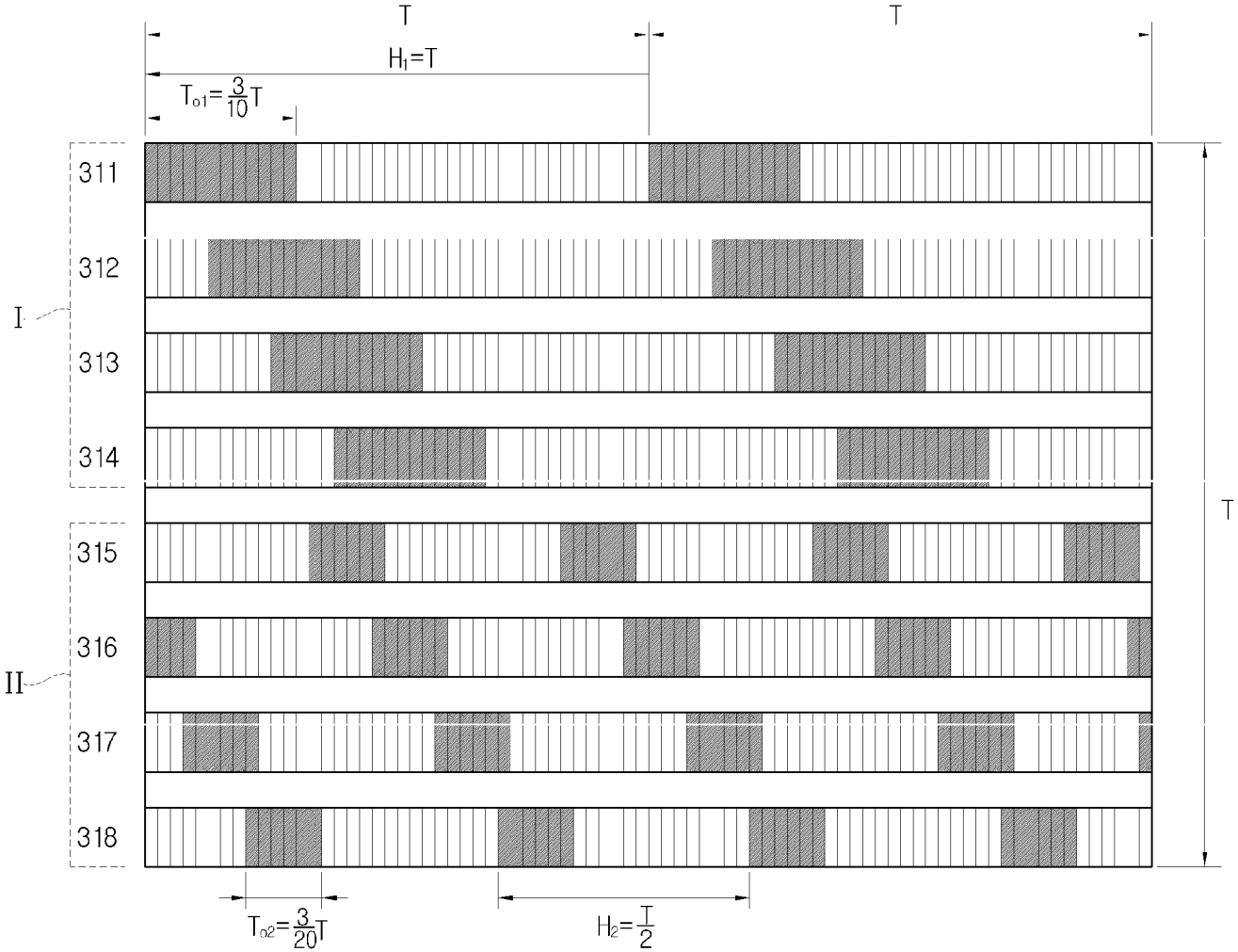
FIGS. 3A and 3B are diagrams for explaining a first example of a control method of the display apparatus according to the exemplary embodiment of the present invention.
Figure 3B:
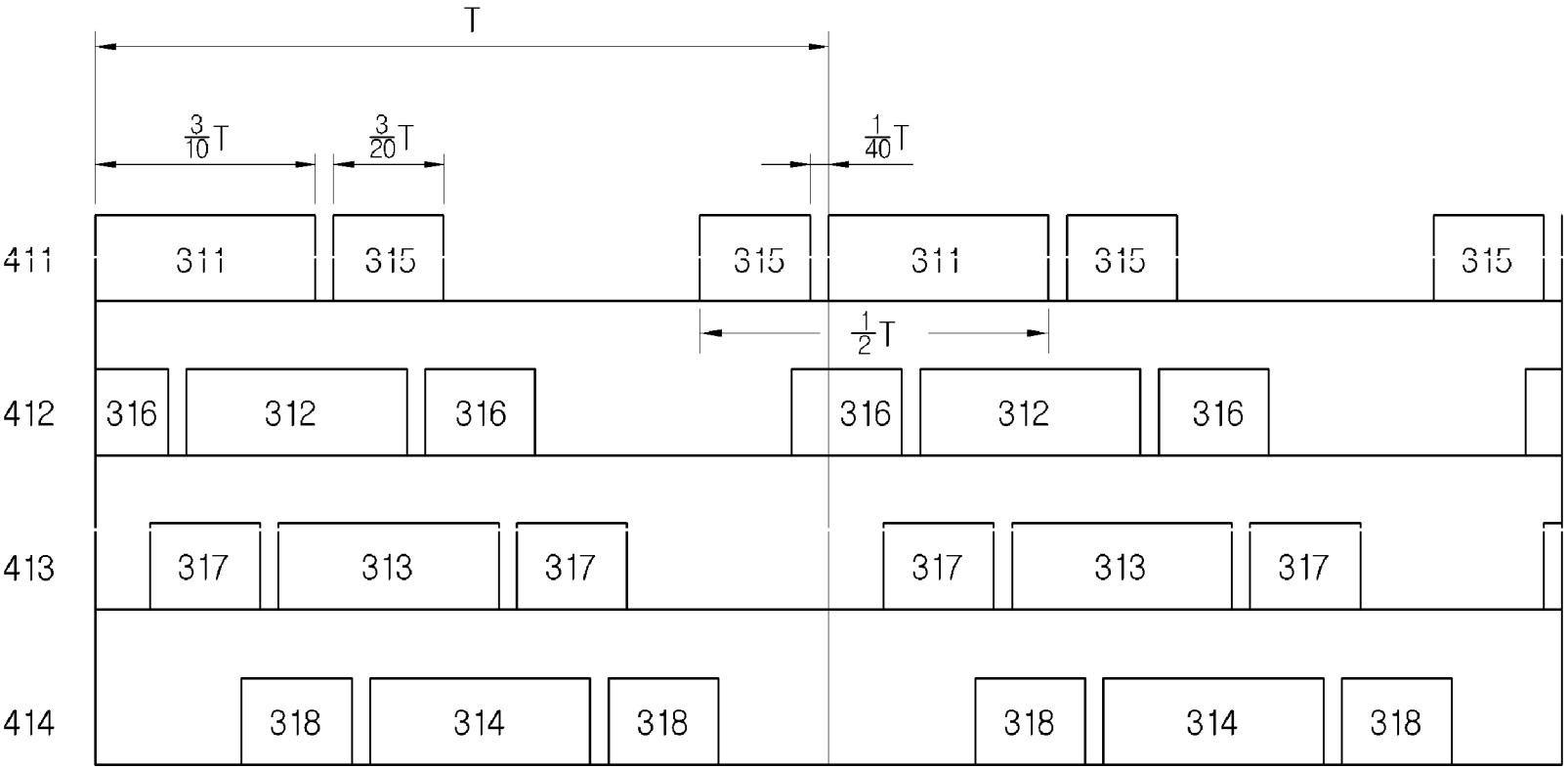

FIGS. 3A and 3B are diagrams for explaining a first example of a control method of the display apparatus according to the exemplary embodiment of the present invention. FIG. 3A illustrates driving of the light source unit 300 according to the exemplary embodiment for each of the division areas 310 which are included in one division area column 300*b*, and FIG. 3B illustrates the same for each of the multiple-drivers 410.

In this exemplary embodiment, motion images are shown at portions corresponding to the first division area and still images are shown in the second division area. The light source controller 500 receives information about the kind of the image signal from the signal controller 210, and controls each multiple-driver 410 to make the lighting period of the division area 310 changed. That is, the light source controller 500 controls the multiple-driver 410 so that a change of the kind of an image signal arising during forming of one frame can be applied to driving of the division area 310 immediately.

As illustrated, a first lighting period H1 of the first division area which is arranged at a portion corresponding to a motion image equals the scanning period T, and a lighting period H2 of the second division area which is arranged at a portion corresponding to a still image corresponds to ½ of the scanning period T. That is, the second division area becomes turned on twice for the scanning period T. A turn-on section $T_{O1}$ of the first division area is 3T/10 equivalent to about 30% of the scanning period T, and a turn-on section $T_{O2}$ of the second division area is 3T/20 equivalent to about 15% of the scanning period T. An interval between the turn-on sections $T_{O1}$ of the first division area corresponds to ½ of the scanning period T, and an interval between the turn-on sections $T_{O2}$ of the second division area corresponds to ¼ of the scanning period T.

The first multiple-driver 411 drives the first division area 311, and drives the fifth division area 315 successively and then drives the first division area 311 again. In other words, the first division area 311 becomes turned on once in two times among the intervals in which the fifth division area 315 is successively turned on. In order to prevent the turn-on section $T_{O1}$ of the first division area 311 and the turn-on section $T_{O2}$ of the fifth division area 315 which are driven by a single multiple-driver 411 from overlapping, a sum of both the turn-on sections $T_{O1}$ and $T_{O2}$ is ½ of the maximum scanning period T. Thus, the turn-on section $T_{O1}$ of the first division area 311 is about 33% at maximum, the turn-on section $T_{O2}$ of the fifth division area 315 is about 16% at maximum. An interval between the turn-on sections of the first division area 311 and the fifth division area 315 is T/40, and this interval can be changed according to the turn-on section of each division area 311 or 315. If a sum of both the turn-on sections $T_{O1}$ and $T_{O2}$ is T/2, an interval between the turn-on sections of the first division area 311 and the fifth division area 315 may not exist.

Driving of the remainder multiple-drivers 413 and 414 following the second multiple-driver 412 which drives the second division area 312 and the sixth division area 316 is equal to the driving of the above-described first multiple-driver 411.

Figure 4:
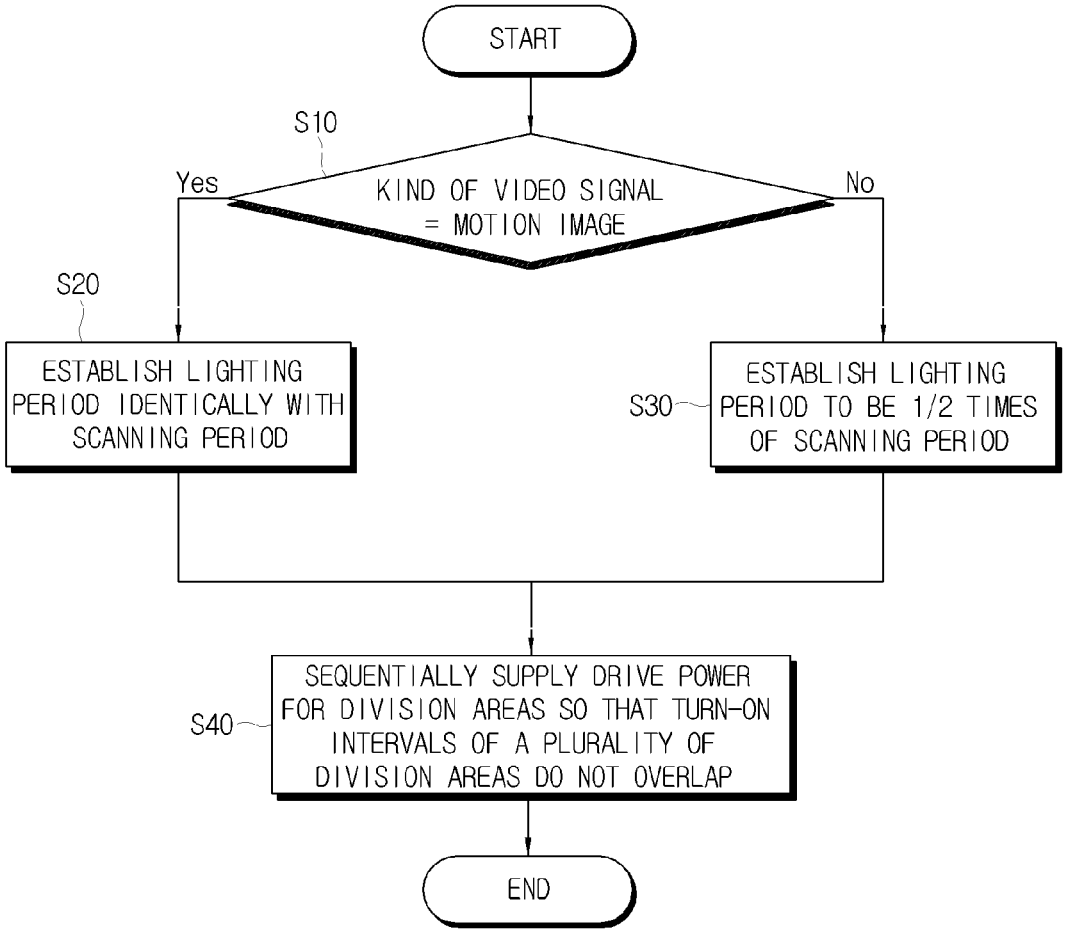
FIG. 4 is a flowchart for explaining the first example of the control method of the display apparatus according to the exemplary embodiment of the present invention.

FIG. 4 is a flowchart explain the first example of the control method of the display apparatus according to the exemplary embodiment of the present invention. The control method will be described below with reference to FIG. 4.

First, the light source controller 500 that receives information about the kind of an image signal from the signal controller 210 judges whether the video signal is a motion image (S10).

In the judgment result, if the image signal is a motion image, a lighting period is established identically with a scanning period (S20). In the case that the lighting period is equal to the scanning period T, the division area 310 becomes turned on once for one frame. The turn-on section during which the division area 310 is turned on is about 10-50% of the scanning period T, and can be preferably but not necessarily set to be about 25-35% thereof.

In the judgment result, if the image signal is a still image other than a motion image, the lighting period is 1/n times of the scanning period. In this exemplary embodiment, since n is 2, the lighting period is set to be ½ of the scanning period T (S30).

If the lighting period is set, the multiple-driver 410 supplies drive power so that a plurality of the division areas 310 which are connected with the multiple-driver 410 does not overlap, and the light source controller 500 controls the multiple-driver 410 so that drive power is sequentially supplied to the division areas 310 which are divided in a column direction (a first direction) (S40).

The ratio of the lighting period to the scanning period, the ratio of the turn-on section to the scanning period, and the number of the division areas 310 which are connected with the multiple-driver 410 are varied according to the size of the display apparatus and required visibility of the motion images, and are not limited to the above-described numerical values.

Figure 5A:
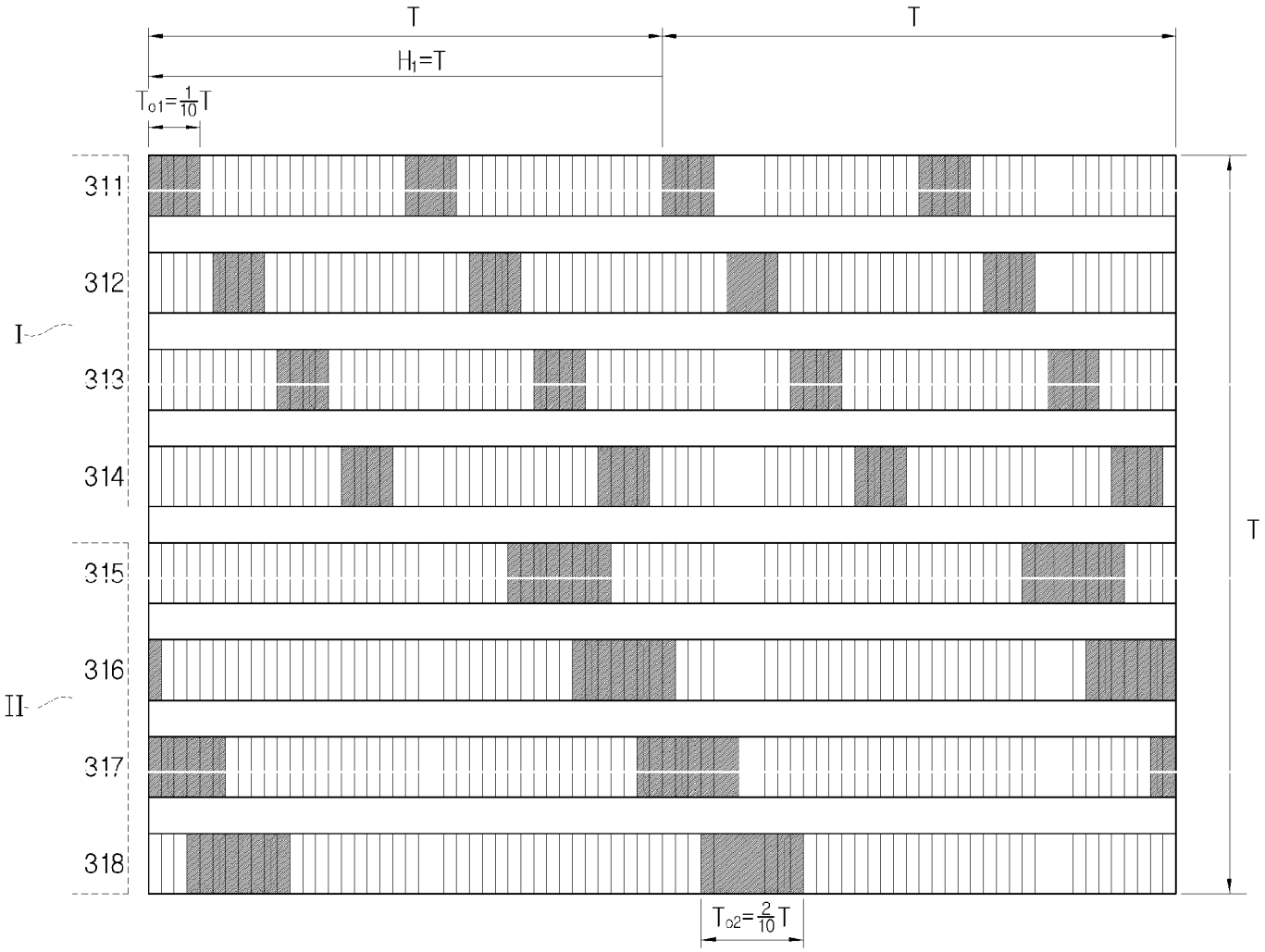
FIGS. 5A and 5B are diagram for explaining a second example of the control method of the display apparatus according to the exemplary embodiment of the present invention.
Figure 5B:
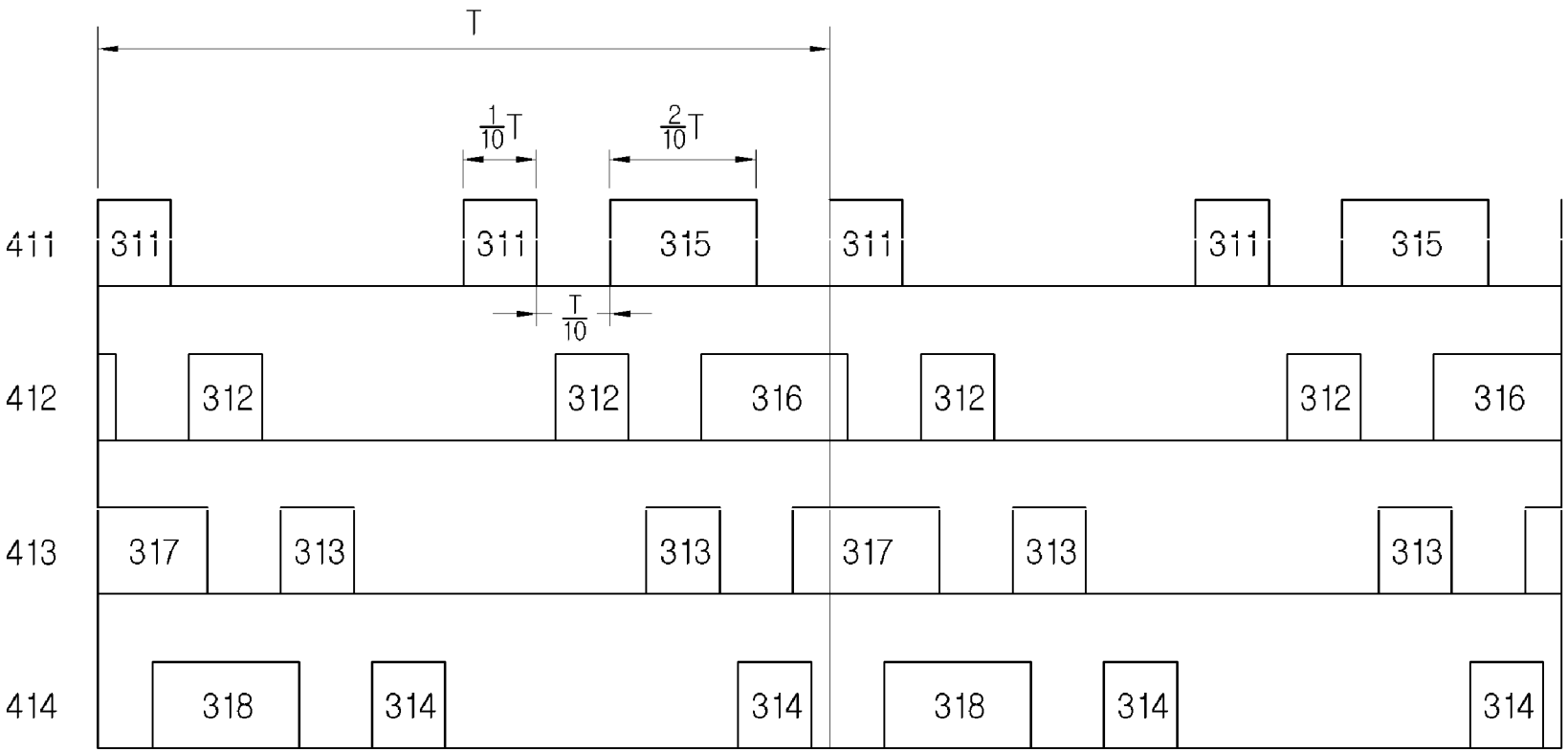

FIGS. 5A and 5B are diagrams to explain a second example of the control method of the display apparatus according to the exemplary embodiment of the present invention. According to this exemplary embodiment, a still image is displayed on the display panel 100 corresponding to the first division area, and a motion image is displayed on the display panel 100 corresponding to the second division area. The turn-on section $T_{O2}$ of the division area 310 is about 20% of the scanning period T for the scanning period T during which one frame is formed, and the lighting period of the first division area is ½ of the second division area. Therefore, the first division area is turned on twice for the scanning period T at a period of T/2 and the turn-on section $T_{O1}$ becomes about 10% of the scanning period T.

As shown in FIG. 5B, the multiple-driver 411 through 414 sequentially supplies drive power for the respective division areas 310 lest the turn-on sections $T_{O1}$ and $T_{O2}$ of a plurality of the division areas 311 through 318 which are connected with the multiple-driver 411 through 414 should overlap. An interval between the turn-on sections $T_{O1}$ and $T_{O2}$ of the first division area 311 and the fifth division area 315 which are connected with the first multiple-driver 411 is T/10.

Figure 6:
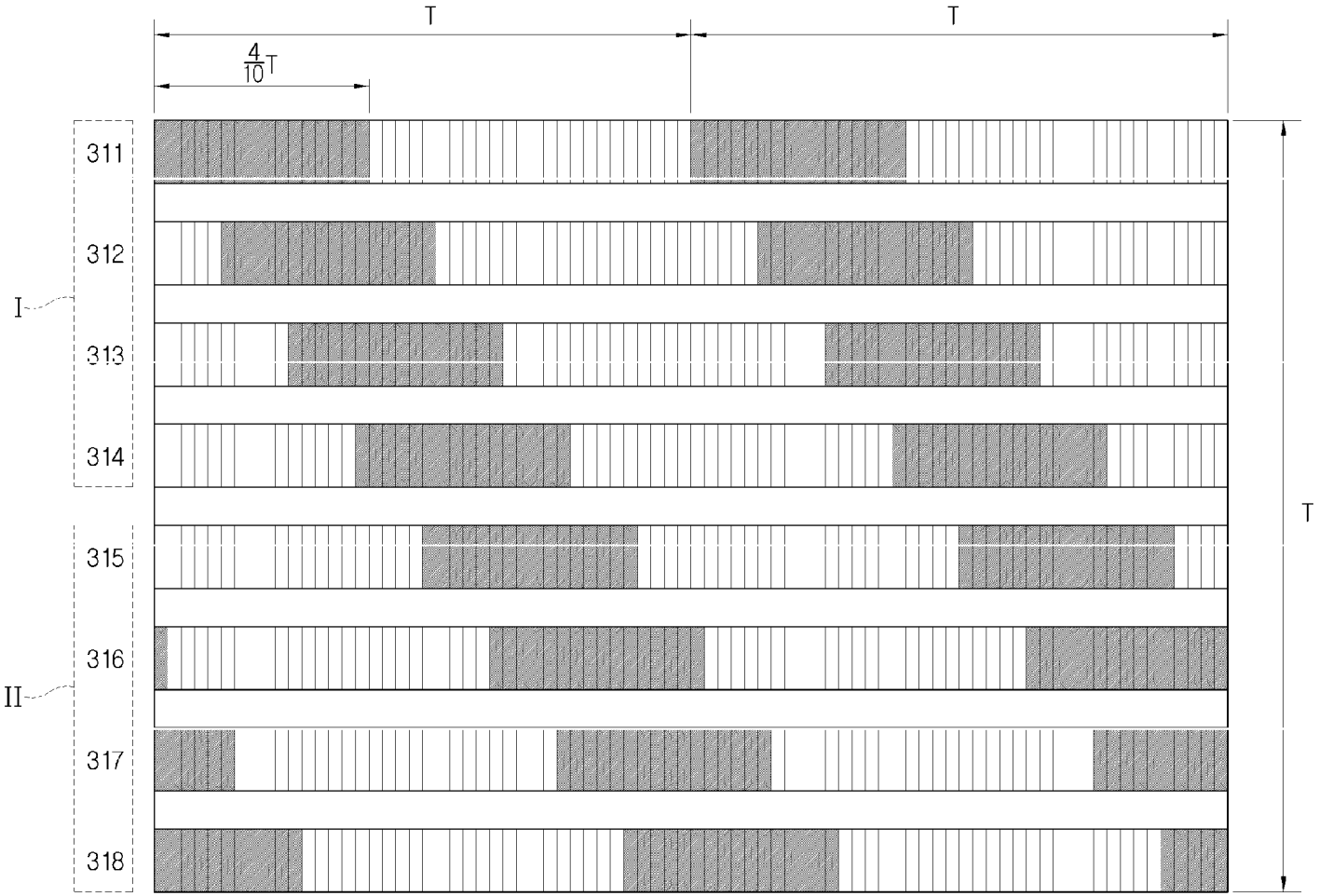
FIG. 6 is a diagram for explaining a third example of the control method of the display apparatus according to the exemplary embodiment of the present invention.

FIG. 6 is a diagram to explain a third example of the control method of the display apparatus according to the exemplary embodiment of the present invention. According to this exemplary embodiment, the image signals corresponding to both the first division area and the second division area are motion images. In this case, both the first division area and the second division area become turned on once for the scanning period T. In addition, as illustrated, start times of the turn-on section $T_{O1}$ of the first division area and the turn-on section $T_{O2}$ of the second division area, that is, an interval of both the turn-on sections $T_{O1}$ and $T_{O2}$, is T/2. According to this exemplary embodiment, the turn-on sections $T_{O1}$ and $T_{O2}$ of the first division area and the second division area is about 40% of the scanning period T respectively.

Figure 7:
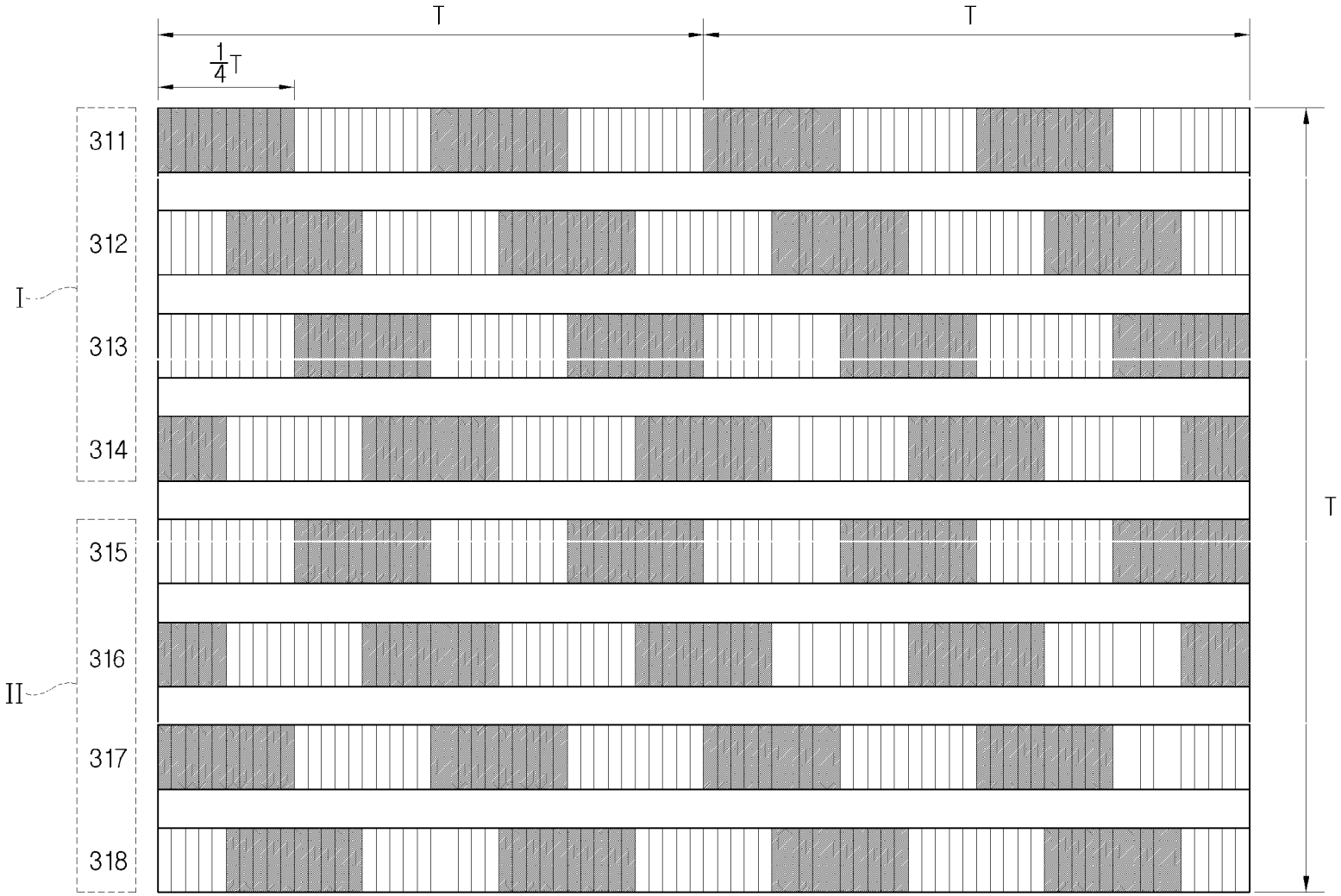
FIG. 7 is a diagram for explaining a fourth example of the control method of the display apparatus according to the exemplary embodiment of the present invention.

FIG. 7 is a diagram to explain a fourth example of the control method of the display apparatus according to the exemplary embodiment of the present invention. According to this exemplary embodiment, the image signals corresponding to both the first division area and the second division area are still images. Accordingly, the lighting period of both the first division area and the second division area is ½ times of the scanning period T respectively and become turned on twice for one frame. In addition, as illustrated, start times of the turn-on section $T_{O1}$ of the first division area and the turn-on section $T_{O2}$ of the second division area, is T/4. According to this exemplary embodiment, the respective turn-on sections $T_{O1}$ and $T_{O2}$ of the first division area and the second division area are about 25% of the scanning period T.

In the cases of the above-stated third and fourth exemplary embodiments, it is assumed that the image signal is not changed. The turn-on sections $T_{O1}$ and $T_{O2}$ according to the third and fourth exemplary embodiments cannot be applied in the case that the kind of the image signal is changed in the first division area and the second division area.

As described above, the present invention provides a backlight unit, a display apparatus and a control method thereof, in which video drag and flicker are reduced.

The present invention also provides a backlight unit, a display apparatus and a control method thereof, in which number of drivers which supply driving power to a light source unit is reduced, thereby saving a manufacturing cost.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A display apparatus comprising:

a display panel;

a light source unit which comprises a light source and has a plurality of division areas which are separated and independently driven from each other, and is located at the back of the display panel;

a drive unit which supplies drive power for the light source unit; and a light source controller which controls the drive unit so that the drive power can be supplied sequentially to the division areas which are divided in a first direction, in synchronization with a scanning period for which one frame of an image signal is displayed, and a lighting period of the division areas can be changed according to the kind of the image signal which is displayed on the display panel, wherein the division areas are arranged in a matrix form, and the drive unit comprises a plurality of multiple-drivers which are connected with at least two of the division areas which belong to different rows which are distant from each other.

2. The display apparatus according to claim 1, wherein, if the image signal displayed on the display panel is a motion image, the lighting period of the division areas is equal to the scanning period.

3. The display apparatus according to claim 1, wherein, if the image signal displayed on the display panel is a still image, the lighting period of the division areas is 1/n times of the scanning period.

4. The display apparatus according to claim 1, wherein turn-on sections of the division areas which are connected with the multiple-drivers do not overlap with one another.

5. The display apparatus according to claim 4, wherein the division areas are arranged in an N×M matrix form, the first direction is a column direction, the division areas comprise a first division area which is arranged in the ith row and a second division area which is arranged in the (M/2+i)th row in the first direction, respectively, and the multiple-driver supplies the drive power to the first division area and the second division area.

6. The display apparatus according to claim 5, wherein, if both an image signal corresponding to the first division area and an image signal corresponding to the second division area are motion images, the lighting periods of the first and second division areas are equal to the scanning period, and start time of the turn-on section of the first division area is different from start time of the turn-on section of the second division area by the scanning time divided by 2.

7. The display apparatus according to claim 6, wherein the turn-on sections of the division areas are about 10% through 50% of the scanning period.

8. The display apparatus according to claim 5, wherein, if both an image signal corresponding to the first division area and an image signal corresponding to the second division area are still images, the lighting periods of the first and second division areas are equal to the scanning period divided by 2, and start time of the turn-on section of the first division area is different from start time of the turn-on section of the second division area by the scanning period divided by 4.

9. The display apparatus according to claim 8, wherein the turn-on sections of the first and second division areas is about 10% through 25% of the scanning period.

10. The display apparatus according to claim 5, wherein, if one of image signals corresponding to the first and second division areas is a motion image and the other is a still image, the lighting period of the division area corresponding to the motion image is equal to the scanning period and the lighting period of the division area corresponding to the still image is equal to the scanning period divided by 2.

11. The display apparatus according to claim 10, wherein the turn-on section of the division area corresponding to the motion image is about 10% through 33% of the scanning period, and the turn-on section of the division area corresponding to the still image is about 10% through 16% of the scanning period.

12. The display apparatus according to claim 1, wherein the light source comprises at least one of a point light source and a surface light source.

13. A backlight unit comprising:

a light source unit which comprises a plurality of light sources and has division areas which are partitioned in a matrix form and independently driven from one another;

a drive unit which comprises a multiple-driver which is connected with at least two division areas belonging to different rows which are distant from each other; and a light source controller which controls the drive unit so that drive power is sequentially supplied to the division areas which are divided in a first direction, in synchronization with a predetermined scanning period, and lighting periods of the division areas are independently changed.

14. The backlight unit according to claim 13, wherein turn-on sections of the division areas which are connected with the multiple-driver do not overlap with one another.

15. The backlight unit according to claim 13, wherein the division areas are arranged in an N×M matrix form, the first direction is a column direction, the division areas comprise a first division area which is arranged in the ith row and a second division area which is arranged in the (M/2+i)th row in the first direction, respectively, and the multiple-driver supplies the drive power to the first division area and the second division area.

16. The backlight unit according to claim 15, wherein, if one of the first and second division areas has a first lighting period which is the same as the scanning period and the other has a second lighting period which corresponds to the first lighting period divided by 2, the turn-on section of the division area having the first lighting period is about 10% through 33% of the scanning period, and the turn-on section of the division area having the second lighting period is about 10% through 16% of the scanning period.

17. The backlight unit according to claim 13, wherein the light source comprises at least one of a point light source and a surface light source.

18. A control method of a display apparatus comprising a display panel, a light source unit having a plurality of light sources, having division areas which are divided and located at the back of the display panel, and a drive unit which supplies drive power to the light source unit, the control method comprising:

establishing a lighting period of at least one division area so as to be changed according to the kind of an image signal displayed on the display panel; and sequentially supplying the division areas divided in a first direction with the drive power corresponding to the lighting periods which have been established, in synchronization with a scanning period during which one frame of the image signal is displayed, to thereby drive the display apparatus.

19. The control method of a display apparatus according to claim 18, wherein, if the image signal displayed on the display panel is a motion image, the lighting period of the division areas is equal to the scanning period.

20. The control method of a display apparatus according to claim 18, wherein, if the image signal displayed on the display panel is a still image, the lighting period of the division areas is a fraction of the scanning period.

21. The control method of a display apparatus according to claim 18, wherein the division areas are arranged in an N×M matrix form, the first direction is a column direction, the division areas comprise a first division area which is arranged in the ith row and a second division area which is arranged in the (M/2+i)th row in the first direction, respectively, and the display apparatus further comprises a multiple-driver which supplies the drive power to the first division area and the second division area.

22. The control method of a display apparatus according to claim 21, wherein the driving comprises supplying the drive power to the first and second division areas so that turn-on sections of the first and second division areas which are connected with the multiple-driver do not overlap with one another.

23. The control method of a display apparatus according to claim 22, wherein, if both an image signal corresponding to the first division area and an image signal corresponding to the second division area are motion images, the lighting periods of the first and second division areas are equal to the scanning period, and start time of the turn-on section of the first division area is different from start time of the turn-on section of the second division area by the scanning period divided by 2.

24. The control method of a display apparatus according to claim 22, wherein, if both an image signal corresponding to the first division area and an image signal corresponding to the second division area are still images, the lighting periods of the first and second division areas are equal to the scanning period divided by 2, and start time of the turn-on section of the first division area is different from start time of the turn-on section of the second division area by the scanning period divided by 4.

25. The control method of a display apparatus according to claim 22, wherein, if one of image signals corresponding to the first and second division areas is a motion image and the other is a still image, the lighting period of the division area corresponding to the motion image is equal to the scanning period and the lighting period of the division area corresponding to the still image is equal to the scanning period divided by 2.

26. The control method of a display apparatus according to claim 18, wherein the lighting period of the division areas are independently determined.

27. The control method of a display apparatus according to claim 18, wherein the control method is incorporated in a computer monitor.

28. A display apparatus comprising:

a display panel;

a light source unit which comprises a light source and has a plurality of division areas arranged in a first matrix form having a plurality of first columns and which are separated and independently driven from each other;

a drive unit which supplies drive power for the light source unit, wherein the drive unit comprises a plurality of multiple-drivers which are arranged in a second matrix form having a second plurality of columns and are connected with at least two of the division areas which belong to different rows which are distant from each other, wherein each of the second plurality of columns of the plurality of multiple-drivers exclusively drives a different column of the first plurality of columns of the plurality of division areas; and a light source controller which controls the drive unit so that the drive power is supplied sequentially to the division areas which are divided in a first direction, in synchronization with a scanning period for which one frame of an image signal is displayed, and so that a lighting period of the division areas is changed according to the kind of the image signal which is displayed on the display panel.

29. The display apparatus according to claim 28, wherein, if the image signal displayed on the display panel is a motion image, the lighting period of the division areas is equal to the scanning period.

30. The display apparatus according to claim 28, wherein, if the image signal displayed on the display panel is a still image, the lighting period of the division areas is 1/n times of the scanning period.

* * * * *